US006591438B1

(12) United States Patent
Edling

(10) Patent No.: US 6,591,438 B1
(45) Date of Patent: Jul. 15, 2003

(54) RETRACTED POCKET SPRING MATTRESS; METHOD FOR MANUFACTURING OF A POCKET SPRING MATTRESS AND DEVICE FOR PRE-TENSIONING POCKETED COIL SPINGS

(75) Inventor: Kenneth Edling, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 0 days.

(21) Appl. No.: 09/936,814

(22) PCT Filed: Mar. 24, 2000

(86) PCT No.: PCT/SE00/00583

§ 371 (c)(1),
(2), (4) Date: Sep. 18, 2001

(87) PCT Pub. No.: WO00/58203

PCT Pub. Date: Oct. 5, 2000

(30) Foreign Application Priority Data

Mar. 25, 1999 (SE) ..... 9901093

(51) Int. Cl.[7] ..... A47C 27/04
(52) U.S. Cl. ..... 5/720; 5/655.8
(58) Field of Search ..... 5/720, 655.8

(56) References Cited

U.S. PATENT DOCUMENTS 1,247,971 A * 11/1917 Krakauer ..... 5/655.8
1,287,662 A 12/1918 Foster
1,287,663 A 12/1918 Foster
3,668,816 A * 6/1972 Thompson ..... 29/91.1
4,234,983 A 11/1980 Stumpf
4,234,984 A * 11/1980 Stumpf ..... 5/655.8
4,451,946 A 6/1984 Stumpf
4,485,506 A 12/1984 Stumpf et al.
4,854,023 A * 8/1989 Stumpf ..... 156/70
4,986,518 A * 1/1991 Stumpf ..... 267/89
5,040,255 A * 8/1991 Barber, Jr. ..... 5/718
5,438,718 A * 8/1995 Kelly et al. ..... 29/91.1
5,553,443 A * 9/1996 St. Clair et al. ..... 53/438
RE35,453 E * 2/1997 Rodgers ..... 5/655.8
5,621,935 A * 4/1997 St. Clair ..... 5/655.8
5,699,998 A 12/1997 Zyman
6,021,627 A * 2/2000 Mossbeck et al. ..... 29/896.92
6,398,199 B1 * 6/2002 Barber ..... 267/93

FOREIGN PATENT DOCUMENTS

SE WO 0244077 A1 * 6/2002 ..... B68G/9/00

* cited by examiner

*Primary Examiner*—J. J. Swann
*Assistant Examiner*—Kathy Mitchell
(74) *Attorney, Agent, or Firm*—Birch, Stewart, Kolasch & Birch, LLP

(57) ABSTRACT

The present invention relates to a spring mattress comprising springs enclosed in casings, a so-called pocket mattress, and a method and a device for manufacturing such a mattress. The spring mattress according to the invention comprises a plurality of interconnected coil springs (1) enclosed in casings (2), for at least one of the springs, the casing portions arranged at the spring ends being moved towards each other, through the spring, and interconnected with the aid of connecting means.

42 Claims, 4 Drawing Sheets

RETRACTED POCKET SPRING MATTRESS; METHOD FOR MANUFACTURING OF A POCKET SPRING MATTRESS AND DEVICE FOR PRE-TENSIONING POCKETED COIL SPINGS

CROSS-REFERENCE TO RELATED APPLICATION

This application is the national phase under 35 U.S.C. §371 of PCT International Application No. PCT/SE00/00583 which has an International filing date of Mar. 24, 2000, which designated the United States of America and was published in English.

FIELD OF THE INVENTION

The present invention relates to a spring mattress comprising springs enclosed in casings, a so-called pocket spring mattress, as well as a method and a device for manufacturing such a mattress.

BACKGROUND ART

A common technique of making spring mattresses is the so-called pocket technique. This means that the springs are enclosed in pockets, i.e. they are individually enclosed by a casing material. In this way, the springs will be relatively individually resilient so that they can flex individually without affecting the neighbouring springs and, thus, the comfort to the user increases since his weight will thus be distributed more uniformly over the surface that receives the load.

A drawback of such mattresses is, however, that it is difficult to make thin mattresses. If the length of the springs is reduced without a corresponding reduction of the width, the spring will, especially when the length approaches the length of the diameter of the spring, have a tendency to turn in the casing, which dramatically deteriorates the comfort of the mattress. When such mattresses are to be manufactured, the existing technique requires a much larger number of springs. Consequently the manufacture will be considerably more expensive and more complicated. Besides it is difficult to prevent such mattresses from also being stiffer since too thin spring wire cannot be used.

For these reasons, it has not been possible to use spring mattresses for many purposes where thinner mattresses are required, such as for bed mattresses, seat cushions and the like. In spite of this, spring mattresses have several properties making it desirable to use them also in these contexts, such as excellent comfort, individual flexibility, a long life and easy and inexpensive manufacture.

OBJECT OF THE INVENTION

It is therefore an object of the present invention to provide a spring mattress of the type mentioned by way of introduction, as well as a method and a device for manufacturing the same, in which the above drawbacks are obviated wholly or at least partly.

This object is achieved by a spring mattress and a method for manufacturing the same according to the appended claims.

BRIEF DESCRIPTION OF THE DRAWINGS

In the accompanying drawings

DESCRIPTION OF THE PREFERRED EMBODIMENTS

For the purpose of exemplification, the invention will now be described in more detail by way of an embodiment and with reference to the accompanying drawings.

A spring mattress according to the invention comprises a plurality of interconnected coil springs 1 enclosed in casings 2. The casing is suitably made of a, preferably weldable, textile material, but also other materials such as different types of plastic materials can be used. It is also possible to use non-weldable textile materials, such as cotton cloth. Such mattresses, so-called pocket spring mattresses, are previously known, and the manufacture thereof is not part of the present invention. Normally, strings of interconnected coil springs in casings are manufactured automatically, whereupon these strings are cut in suitable lengths and joined side by side to form mattresses.

According to the invention, for at least one of the springs, the casing portions 3, 4 arranged at the spring ends are moved towards each other, through the spring, and interconnected with the aid of connecting means to provide at least a certain degree of bias. Preferably, the casing portions 3, 4 are moved so far towards each other as to make contact, but it is, of course, possible to interconnect them also otherwise, by means of wire, a long clamp or the like. The connecting means may consist of a mechanical interconnecting element, such as a clamp, a rivet or the like, or a surface joint, such as a glue, a welding seam or the like. Other fixing elements are, however, also conceivable. The load exerted on the fixing elements is normally small since the fixing elements are only loaded if the mattress is unloaded, whereas there is no load at all if the mattress is loaded.

The mattress according to the invention can be manufactured by the steps of enclosing springs in a casing material, biasing at least one of the springs and interconnecting the springs. By the step of biasing the springs is, in this case, meant moving casing portions arranged for the ends of the spring towards each other and interconnect them by means of connecting elements in such manner that the springs in the biased state have a smaller longitudinal extent than in the original, non-biased state. This bias can occur either immediately after encapsulating the springs in the casing material, i.e. before assembling them to form a mattress, or when the mattress has been assembled. Preferably, the bias occurs, however, when the springs are located in strings, and conveniently bias of all springs in the mattress layer occurs in this way.

Figure 3:
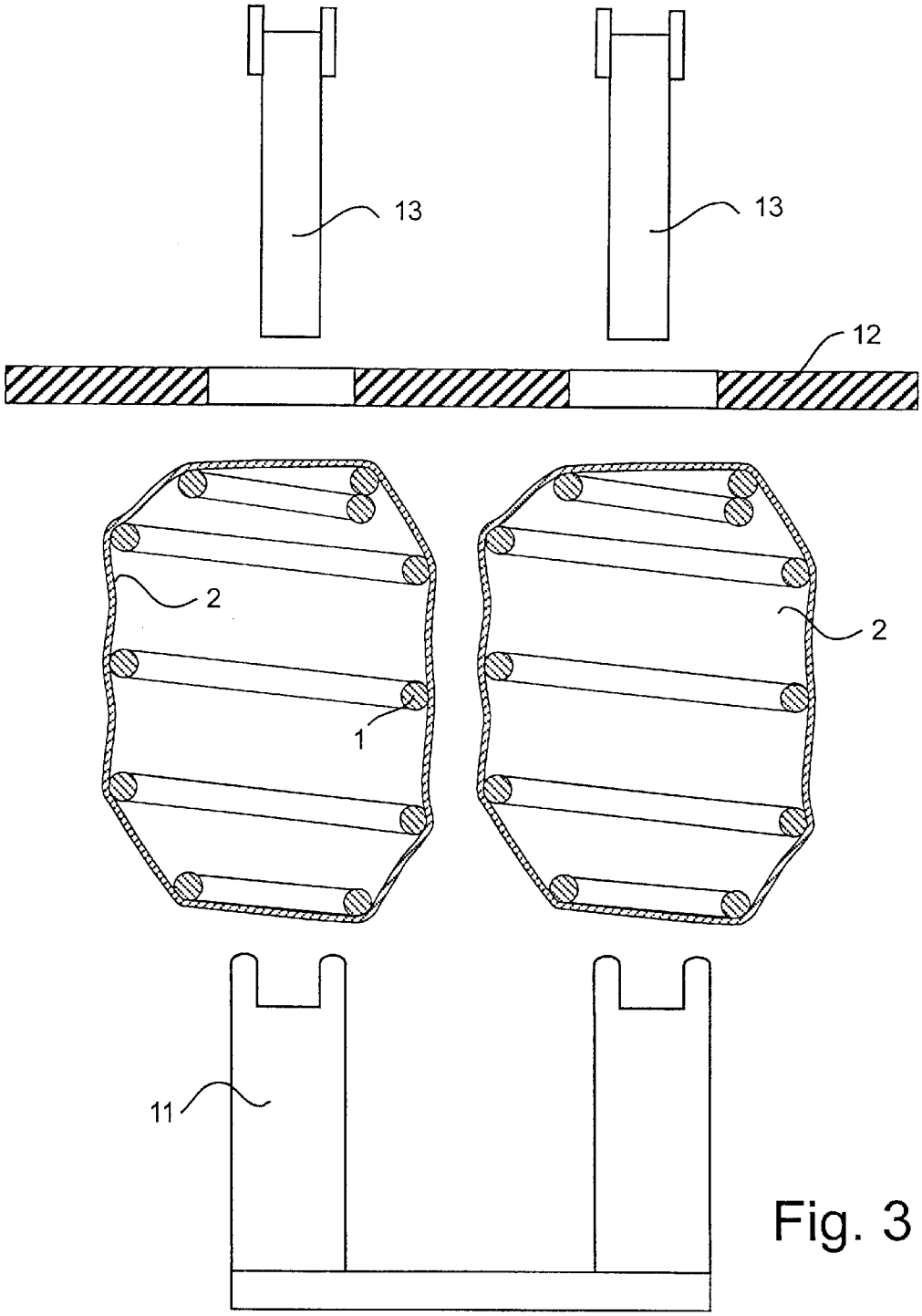
FIG. 3 is a schematic sectional view of the device in FIG. 1 from above.
Figure 4A:
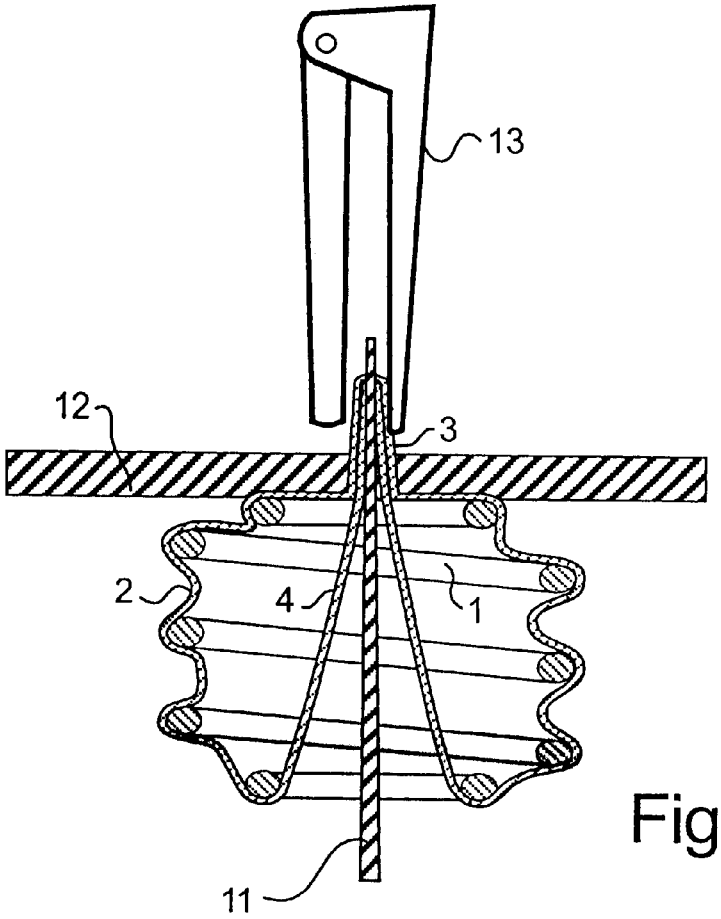
FIG. 4*a* is a schematic sectional view of the device in FIG. 1, seen from the side, the inserting means being inserted past the abutment member.
Figure 4B:
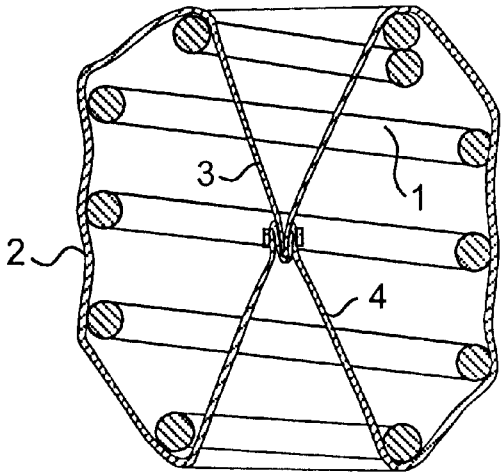
FIG. 4*b* is a schematic sectional side view of a finished spring element according to the invention.

A device for carrying out the method above comprises according to the invention an inserting means 11 and an abutment member 12 arranged at a distance therefrom. In use, springs are arranged so that one end is directed towards the inserting means and the other towards the abutment member. The inserting means is displaceable towards and away from the abutment member for moving casing material at one spring end through the spring towards the casing material on the other side. Moreover, fixing means 13 are provided to form fixing members which interconnect the casing materials from both spring ends. Preferably, the inserting means is movable past the abutment member, and the fixing means is arranged on the opposite side thereof, as shown in the embodiment. In this manner, the inserting means can move the casing material out from both the front and the rear end of the spring through an opening in the abutment member while the abutment member prevents the spring from coming along. The fixing means can then fix together the casing materials with the aid of a mechanical fixing member, such as a clamp, or by means of surface joining, such as by gluing or welding. A system according to the invention may advantageously comprise a plurality of parallel devices, such as two devices operating in parallel, which is shown in the embodiment. FIG. 3 is a top plan view of the device according to this embodiment of the invention, in a position where the inserting means 11 are not inserted towards the abutment member 12. FIG. 4*a* illustrates the same device, but seen from the side, with the inserting means 11 in a position where it is inserted past and through the abutment member 12. The casing material 2 is made to come along and can be fixed together with a clamp or the like by the fixing means 13. A finished spring element according to the invention is also shown schematically in FIG. 4*b*.

It goes without saying that also other types of fixing means can be used. It is also possible to use a movable abutment member, in which case both sides of the spring are pressed towards each other, whereupon fastening, welding or equivalent interconnecting can take place. In this manner, the freedom of choice when placing the fixing element will, however, be affected.

Coil springs of many sizes can be used in connection with the present invention, and essentially any size of springs may be used. It is, however, preferable to use springs having a diameter of 2–10 cm, most preferred about 6 cm.

Moreover, it is preferred for the bias of the springs to be carried out so that the length of the springs in the biased state is smaller than ⅔ of the length of the same springs in the non-biased, original state, preferably smaller than ½. Moreover it is preferred for the ratio of spring length to spring diameter in the biased state to be smaller than 2, preferably smaller than 1, most preferably smaller than ½.

Figure 1:
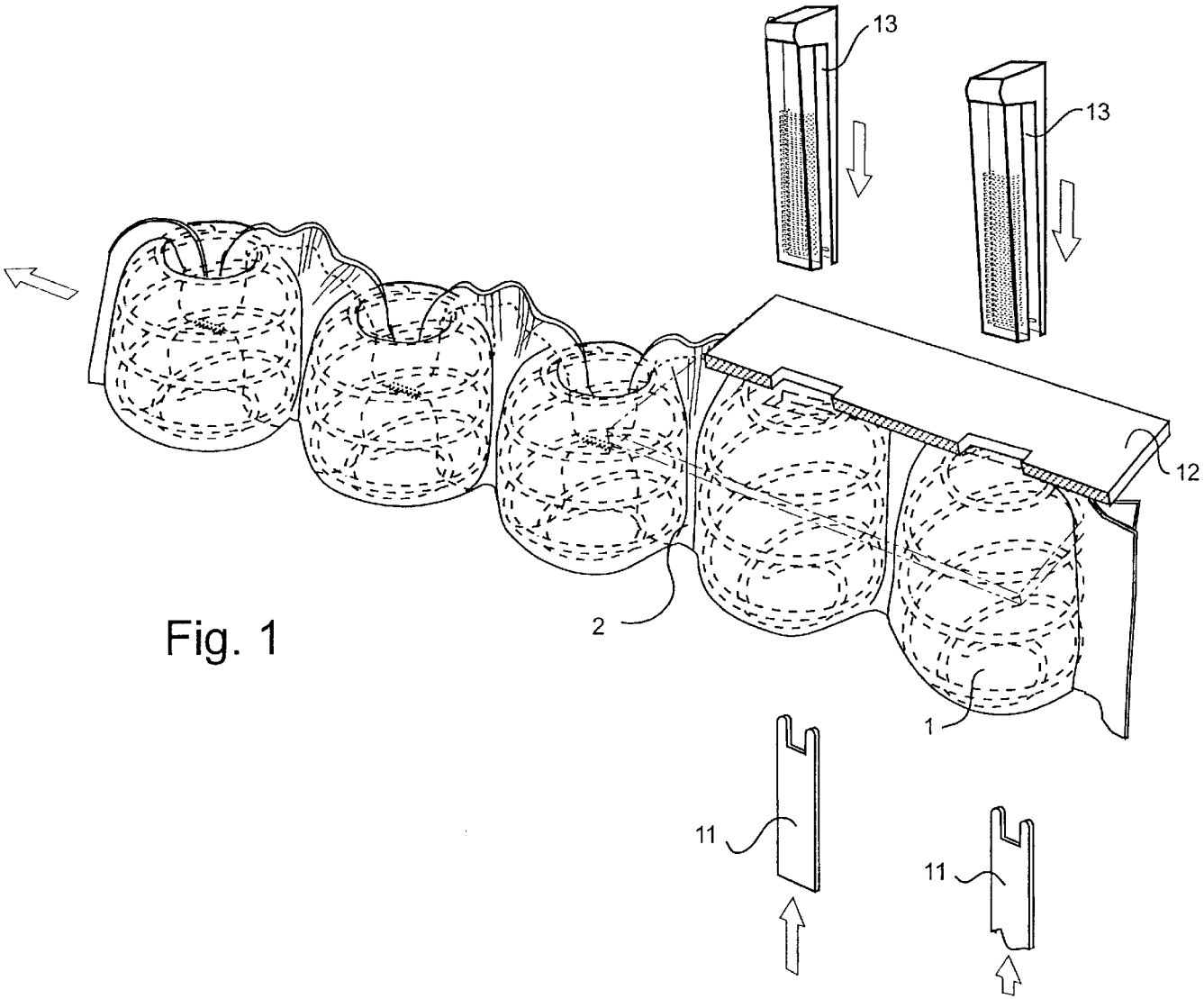
FIG. 1 illustrates a device for manufacturing a mattress according to an embodiment of the invention.
Figure 2:
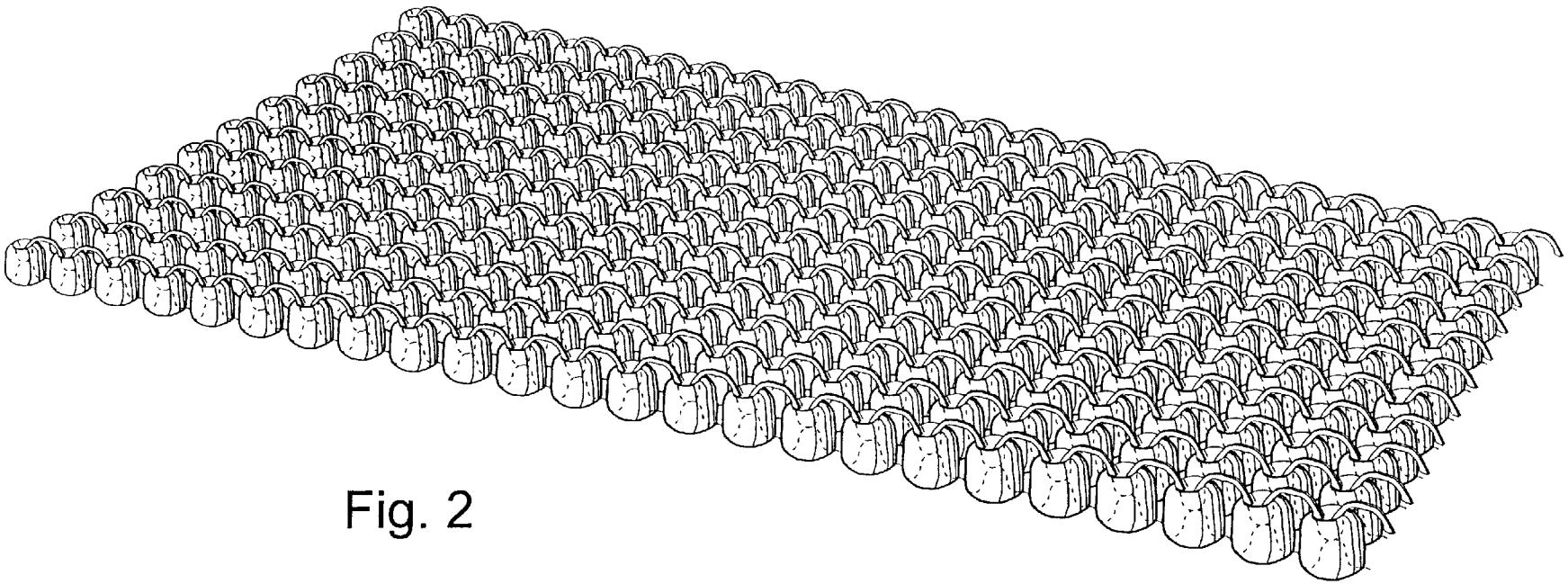
FIG. 2 illustrates a mattress according to an embodiment of the invention.

As mentioned above, the casings with springs are arranged preferably in successive rows, after which such rows are fixed to each other side by side, as indicated in FIG. 2. Preferably, the rows are fixed to each other at two or three fixing points distributed in the vertical direction in front of each spring. It goes without saying that a smaller or larger number of fixing points is possible. It is also possible to arrange an extended fixing line essentially parallel with the longitudinal direction of the springs instead of a plurality of fixing points. The interconnection of rows can take place by welding or gluing. Also such interconnecting can, however, alternatively be effected by means of clamps, Velcro tape or in some other convenient manner.

With the inventive mattress, controlling of the spring is achieved, which is thus prevented from turning or the like. In this way, it is possible to make very thin mattresses, optionally down to a thickness of one or a few centimetres. The invention thus is well suited for seat cushions, bed mattresses to be placed on top of other mattresses and similar applications where thin mattresses are required. It is very advantageous to be able to make bed mattresses of coil springs in this manner, not only to be able to make them thinner, thereby increasing their comfort, but also since springs are normally not subject to fatigue as time goes by, as are polyethylene and like materials. Mattresses according to the invention can be made very light, soft and comfortable, but also, owing to the bias, very stiff and hard, as desired.

By means of the invention, the height of the spring elements can easily be controlled by varying the position of the fixing member. The more the casing portions from the spring ends are moved towards each other and the more they are made to overlap when interconnected, the thinner and more compact the mattress. In this way it is also easy to provide different thickness in different portions of the mattress, or to provide mattresses having different thicknesses, without having to change anything in the manufacturing process but the interconnection. The manufacture will thus be very flexible and controllable. Particularly, it is possible to provide mattresses which are bowl-shaped or the like for use as seat cushions or other mattresses intended to be used as seats. Similar changes in height can also be used in other mattresses to control the user's position on the mattress.

By the casing material being pulled together over the springs according to the invention, the entire mattress is also pulled together to some extent. As a result, the mattress is stabilised, and no frame or the like is necessary. Furthermore, the pulling together may force the springs to mesh somewhat while the casing material is arranged between them. This is desirable since this prevents the mattress from making noise that arises when uncovered spring turns strike against each other.

The invention has been described above by way of an embodiment. Several variants of the invention are, however, conceivable. For instance, it is possible to use, as mentioned above, other types of fixing elements, as well as other casing materials, spring sizes etc. Furthermore the device and method can be designed in different ways. Such close variants must be considered to be comprised by the invention as defined in the appended claims.

What is claimed is:

1. A spring mattress comprising:

a plurality of interconnected coil springs;

casings individually enclosing at least two of the springs, each of said casings having a longitudinally continuous casing portion arranged at the upper end and a different longitudinally continuous casing portion arranged at the lower end of the at least one of the springs, said casing portions being moved towards each other, through the at least two of the springs, and being interconnected with the aid of connecting means, thereby biasing each of the at least two of the springs.

2. The spring mattress as claimed in claim 1, wherein the casing portions are moved to contact each other.

3. The spring mattress as claimed in claim 2, wherein the connecting means is arranged to provide an overlap between the casing portions, the overlap determining the bias of each of the at least two of the springs.

4. The spring mattress as claimed in claim 2, wherein the connecting means is a mechanical connecting element.

5. The spring mattress as claimed in claim 2, wherein the connecting means is a surface joint.

6. The spring mattress as claimed in claim 1, wherein the casing is a weldable textile material.

7. The spring mattress as claimed in claim 1, wherein each of the at least two of the springs is biased so that a length thereof in the biased state is smaller than ⅔ of the length thereof in a non-biased state.

8. The spring mattress as claimed in claim 7, wherein each of the at least two of the springs is biased so that a length thereof in the biased state is smaller than one-half of the length thereof in a non-biased state.

9. The spring mattress as claimed in claim 1, wherein a ratio of a spring length to a spring diameter in the biased state is smaller than 2.

10. The spring mattress as claimed in claim 9, wherein a ratio of a spring length to a spring diameter in the biased state is smaller than 1.

11. The spring mattress as claimed in claim 9, wherein a ratio of a spring length to a spring diameter in the biased state is smaller than one-half.

12. The spring mattress as claimed in claim 1, comprising a plurality of biased springs, wherein at least some of the springs are differently biased.

13. The spring mattress as claimed in claim 12, wherein the springs are differently biased so as to form portions of the mattress of varying thickness.

14. The spring mattress as claimed in claim 2, wherein the connecting means is a clamp.

15. The spring mattress as claimed in claim 2, wherein the connecting means is a glue.

16. The spring mattress as claimed in claim 2, wherein the connecting means is a welding seam.

17. A method for manufacturing a spring mattress comprising a plurality of interconnected coil springs enclosed in casings, comprising the steps of:

enclosing the springs in a casing material, said casing material having casing portions arranged such that a longitudinally continuous casing portion is arranged at an upper end and a different longitudinally continuous casing portion is arranged at a lower end of the at least one of the springs;

biasing at least two of the springs; and interconnecting the springs, the step of biasing the at least two of the springs comprising the steps of moving said casing portions arranged at ends of each of the at least two of the springs towards each other, and interconnecting said casing portions by means of connecting elements.

18. The method as claimed in claim 17, wherein the casing portions are moved to contact each other.

19. The method as claimed in claim 18, wherein the bias of the at least two of the springs is controlled by the positioning of the connecting elements, and an overlap between the casing portions.

20. The method as claimed in claim 18, wherein the connecting elements are mechanical interconnecting elements.

21. The method as claimed in claim 18, wherein the connecting elements are surface joints.

22. The method as claimed in claim 18, wherein the connecting elements are clamps.

23. The method as claimed in claim 18, wherein the connecting elements are glues.

24. The method as claimed in claim 18, wherein the connecting elements are welding seams.

25. The method as claimed in claim 17, wherein prior to the biasing step the method further comprises the step of interconnecting the springs enclosed in said casing material in successive rows, and after the biasing step the method comprises the step of interconnecting the rows in a juxtaposed manner.

26. The method as claimed in claim 17, wherein essentially all of the springs in the mattress are biased.

27. The method as claimed in claim 17, wherein the step of biasing is carried out in such manner that each of the at least two of the springs has a length in the biased state that is smaller than ⅔ of the length of the same spring in a non-biased state.

28. The method as claimed in claim 27, wherein the step of biasing is carried out in such manner that each of the at least two of the springs has a length in the biased state that is smaller than one-half of the length of the same spring in a non-biased state.

29. The method as claimed in claim 17, wherein the step of biasing is carried out in such manner that the ratio of a spring length to a spring diameter in the biased state is smaller than 2.

30. The method as claimed in claim 29, wherein the step of biasing is carried out in such manner that the ratio of a spring length to a spring diameter in the biased state is smaller than 1.

31. The method as claimed in claim 29, wherein the step of biasing is carried out in such manner that the ratio of a spring length to a spring diameter in the biased state is smaller than one-half.

32. The method as claimed in claim 17, wherein the springs being biased to different extents.

33. The spring mattress as claimed in claim 32, wherein the springs are biased so as to form portions of the mattress of varying thickness.

34. A device for biasing coil springs enclosed in casings, comprising:

inserting means provided at a first longitudinally continuous casing portion arranged at first end of a first spring to be biased; and counteracting means arranged at a distance therefrom at a second longitudinally continuous casing portion arranged at a second end of said first spring to be biased, the inserting means and the counteracting means capable of moving towards and away from each other to bring said first and second longitudinally continuous casing portions towards each other through the spring to be biased; and fixing means for arranging fixing members which interconnect the first and second longitudinally continuous casting portions from the two spring ends.

35. The device as claimed in claim 34, wherein the counteracting means is a passive abutment member, the inserting means being displaceable towards and away from said abutment member.

36. The device as claimed in claim 35, wherein the inserting means is displaceable past the abutment member, and the fixing means and the abutment member are arranged, respectively, on said first and second ends of the first spring to be biased.

37. The device as claimed in claim 36, wherein an extent to which the inserting means is displaceable past the abutment member is controllable.

38. The device as claimed in claim 34, wherein the fixing means is adapted to fix said casing portions with the aid of a mechanical fixing member.

39. The device as claimed in claim 34, wherein the fixing means is adapted to fix said casing portions with the aid of a surface-connecting fixing member.

40. The device as claimed in claim 34, wherein the fixing means is a clamp.

41. The device as claimed in claim 34, wherein the fixing means is a glue.

42. The device as claimed in claim 34, wherein the fixing means is a welding seam.

* * * * *

UNITED STATES PATENT AND TRADEMARK OFFICE

CERTIFICATE OF CORRECTION

PATENT NO. : 6,591,438 B1
DATED : July 15, 2003
INVENTOR(S) : Edling, Kenneth

It is certified that error appears in the above-identified patent and that said Letters Patent is hereby corrected as shown below:

Title page,
Item [54], Title, should read as follows:
-- RETRACTED POCKET SPRING MATTRESS; METHOD FOR MANUFACTURING OF A POCKET SPRING MATTRESS AND DEVICE FOR PRE-TENSIONING POCKETED COIL SPRINGS --

Signed and Sealed this

Twenty-third Day of March, 2004

JON W. DUDAS
*Acting Director of the United States Patent and Trademark Office*